US009397424B2

(12) United States Patent
Figuerado et al.

(10) Patent No.: US 9,397,424 B2
(45) Date of Patent: Jul. 19, 2016

(54) CONNECTOR ASSEMBLY FOR ELECTRICALLY COUPLING A MODULE CARD TO A CIRCUIT BOARD

(71) Applicant: Tyco Electronics Corporation, Berwyn, PA (US)

(72) Inventors: Stephen N. Figuerado, Round Rock, TX (US); James L. McGrath, Barrington, IL (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/568,986

(22) Filed: Dec. 12, 2014

(65) Prior Publication Data

US 2016/0149323 A1 May 26, 2016

Related U.S. Application Data

(60) Provisional application No. 62/084,135, filed on Nov. 25, 2014.

(51) Int. Cl.
*H01R 13/62* (2006.01)
*H01R 12/71* (2011.01)
*H01R 13/627* (2006.01)

(52) U.S. Cl.
CPC ..... *H01R 12/716* (2013.01); *H01R 13/6272* (2013.01)

(58) Field of Classification Search
USPC ..... 439/326–328
See application file for complete search history.

(56) References Cited

U.S. PATENT DOCUMENTS 6,053,757 A * 4/2000 Turnbull ..... H01R 12/721 439/326
8,986,047 B2 * 3/2015 Lai ..... G06F 1/185 439/328

FOREIGN PATENT DOCUMENTS

CN 203277829 U 11/2013
CN 103472900 A 12/2013

* cited by examiner

*Primary Examiner* — Xuong Chung Trans

(57) ABSTRACT

Connector assembly including a board connector configured to be mounted to a circuit board. The board connector includes a connector housing having a reception slot. The reception slot opens in a vertical direction that is parallel to an elevation axis. The elevation axis is perpendicular to the circuit board when the board connector is mounted thereto. The board connector also includes electrical contacts that are positioned along the reception slot. The electrical contacts are configured to engage corresponding contacts of a module card. The connector assembly also includes a coupling mechanism attached to the board connector. The coupling mechanism includes a support frame that extends away from the board connector along the elevation axis. The coupling mechanism also includes a latch body that is attached to the support frame and faces the reception slot to define a module-receiving space therebetween that is configured to receive the module card.

20 Claims, 5 Drawing Sheets

CONNECTOR ASSEMBLY FOR ELECTRICALLY COUPLING A MODULE CARD TO A CIRCUIT BOARD

CROSS-REFERENCE TO RELATED APPLICATIONS

The present application claims priority to and the benefit of U.S. Provisional Application No. 62/084,135, filed on Nov. 25, 2014 and entitled the same, which is incorporated herein by reference in its entirety.

BACKGROUND

The subject matter herein relates generally to electrical connector assemblies that are configured to receive module cards and communication systems having the same.

Communication systems, such as routers, servers, uninterruptible power supplies (UPSs), supercomputers, and other computing systems, may be complex systems that have a number of components interconnected to one another. In many communication systems, several components may be mounted to a single circuit board and may be interconnected to one another through the circuit board. For example, server systems include blade servers (or blades) in which each blade server has a number of different components, referred to as onboard devices, that are mounted to a common circuit board. The onboard devices may include a number of processors, storage devices, and electrical connectors. In many configurations, the blade server also includes one or more hard disk drives (HDDs) that are also mounted to the circuit board. The HDDs are primarily used to initiate (i.e., boot up) different processes in the onboard devices. After the HDDs boot up the onboard devices, the HDDs may have limited functionality.

Although the HDDs are effective in booting up the onboard devices, the HDDs require a substantial amount of space along the circuit board and may require a substantial amount of power for operation. It may be possible to replace the HDDs with other components that are capable of performing the same functions. These other components, however, may also present challenges with respect to space along the circuit board. In addition to HDDs, it may be desirable to replace other devices with devices that have a smaller form factor but provide a similar level of performance.

Accordingly, a need exists for a communication device that is capable of being mounted to a circuit board, but requires a smaller footprint along the circuit board than known devices, such as HDDs.

BRIEF DESCRIPTION

In an embodiment, a connector assembly is provided that includes a board connector configured to be mounted to a circuit board. The board connector includes a connector housing having a reception slot. The reception slot opens in a vertical direction that is parallel to an elevation axis. The elevation axis is perpendicular to the circuit board when the board connector is mounted thereto. The board connector also includes electrical contacts that are positioned along the reception slot. The electrical contacts are configured to engage corresponding contacts of a module card. The connector assembly also includes a coupling mechanism attached to the board connector. The coupling mechanism includes a support frame that extends away from the board connector along the elevation axis. The coupling mechanism also includes a latch body that is attached to the support frame and faces the reception slot to define a module-receiving space therebetween that is configured to receive the module card.

In an embodiment, a communication system is provided that includes a circuit board oriented perpendicular to an elevation axis. The communication system also includes a board connector mounted to the circuit board. The board connector includes a connector housing having a reception slot that opens in a vertical direction parallel to the elevation axis. The reception slot extends lengthwise parallel to the circuit board. The board connector also includes an array of electrical contacts that are exposed along the reception slot. The communication system also includes a coupling mechanism having a support frame that has a fixed position with respect to the board connector and extends away from the board connector along the elevation axis. The coupling mechanism also includes a latch body attached to the support frame that faces the reception slot and defines a module-receiving space therebetween for receiving a module card.

DETAILED DESCRIPTION

Figure 1:
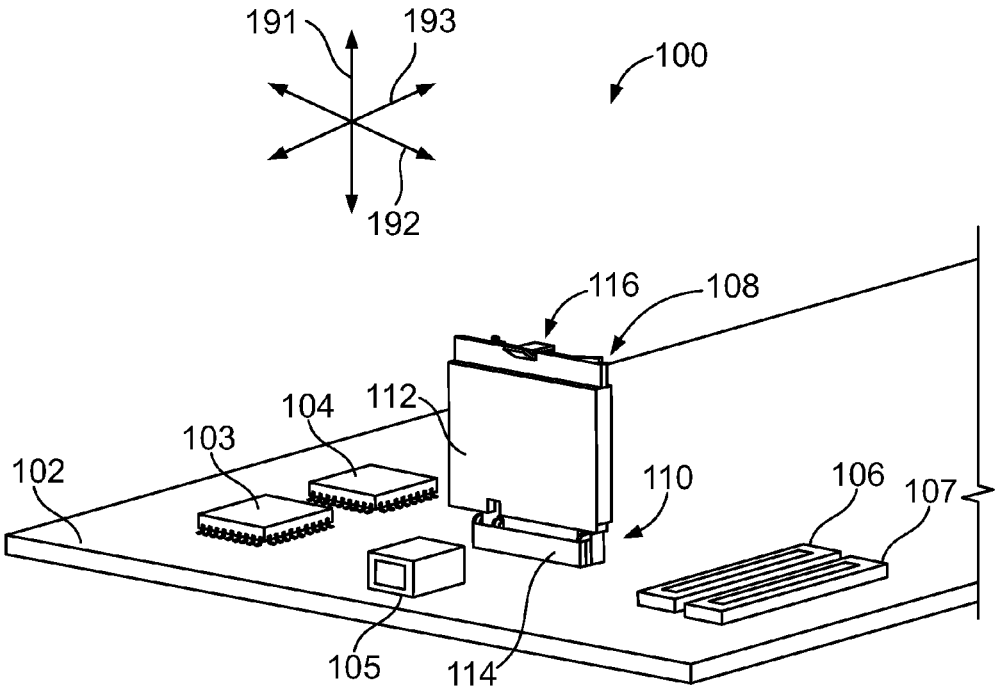
FIG. 1 is a perspective view of a communication system having a connector assembly formed in accordance with an embodiment.

FIG. 1 is a front perspective view of a portion of a communication system 100 formed in accordance with an embodiment. The communication system 100 includes a circuit board 102 having a plurality of onboard devices 103-108 mounted thereto. The communication system 100 is oriented with respect to mutually perpendicular axes 191-193, including an elevation axis 191, a first lateral axis 192, and a second lateral axis 193. The elevation axis 191 is perpendicular or orthogonal to the circuit board 102. In other words, the circuit board 102 may extend parallel to a plane defined by the first lateral axis 192 and the second lateral axis 193. In some embodiments, the elevation axis 191 extends parallel to a gravitational force direction. However, embodiments set forth herein are not required to have any particular orientation with respect to gravity. For example, in other embodiments, the first lateral axis 192 may extend parallel to the gravitational force direction.

The onboard devices 103-108 are examples of the various devices that may be used. Each of the onboard devices 103-108 is configured to at least transmit electrical data signals. In some embodiments, the onboard devices 103-108 may process input signals in a designated manner and provide output data signals. The onboard devices 103-108 may include, for example, memory card connectors, processors, storage devices, input/output (I/O) connectors, and the like. The communication system 100 may include more or fewer onboard devices than those shown in FIG. 1.

In the illustrated embodiment, the onboard devices include a communication device 108 that has a connector assembly 110 operably coupled to a module card 112. The connector assembly 110 includes a board connector 114 that receives the module card 112 and a coupling mechanism 116 that holds the module card 112 in a loaded position with respect to the board connector 114. More specifically, the coupling mechanism 116 holds the module card 112 at a designated orientation while the module card 112 is communicatively coupled to the board connector 114. In some embodiments, the module card 112 may be used to initiate (e.g., boot) the other onboard devices 103-107, among others. For example, the module card 112 may include or constitute a solid-state device (SSD). As described herein, the communication device 108 and the connector assembly 110 may occupy a reduced area or space compared to other known devices. For example, the communication device 108 may occupy less space than a conventional hard disk drive (HDD), which is typically oriented parallel to the circuit board.

In the illustrated embodiment, the connector assembly 110 is an upright or vertical assembly that extends away from the circuit board 102 and has a designated orientation with respect to the first and second lateral axes 192, 193. For example, the connector assembly 110 extends generally parallel to a plane defined by the first lateral axis 192 and the elevation axis 191. In other embodiments, however, the connector assembly 110 may be rotated to extend generally parallel to a plane defined by the second lateral axis 193 and the elevation axis 191.

Figure 3:
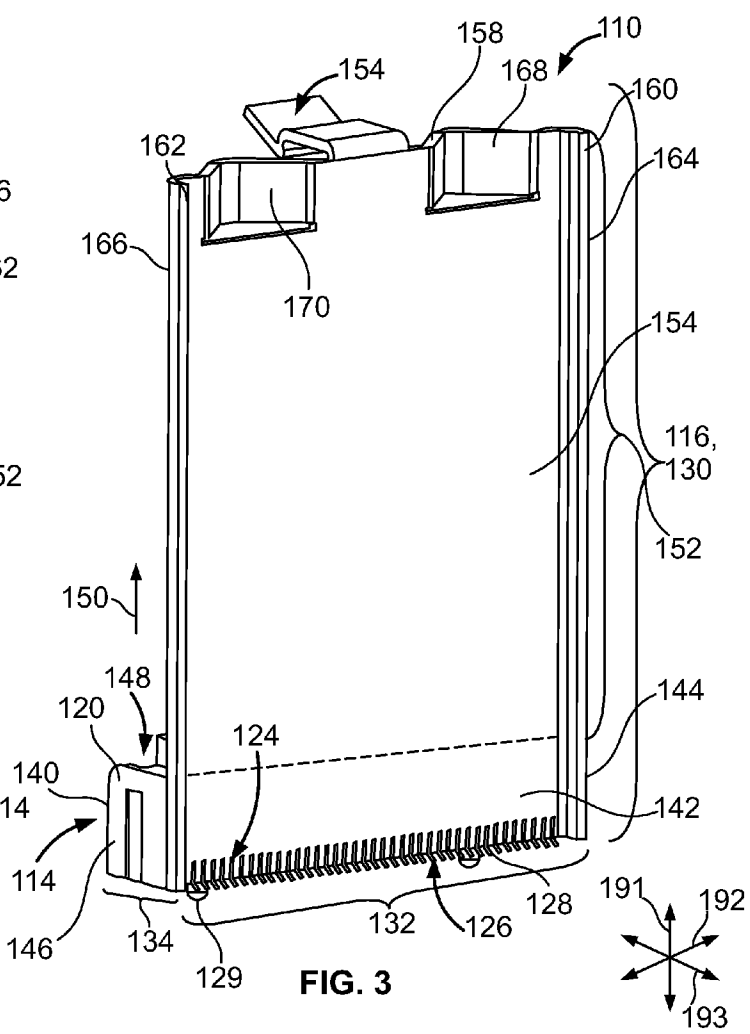
FIG. 3 is an isolated back perspective view of the connector assembly of FIG. 1.
Figure 2:
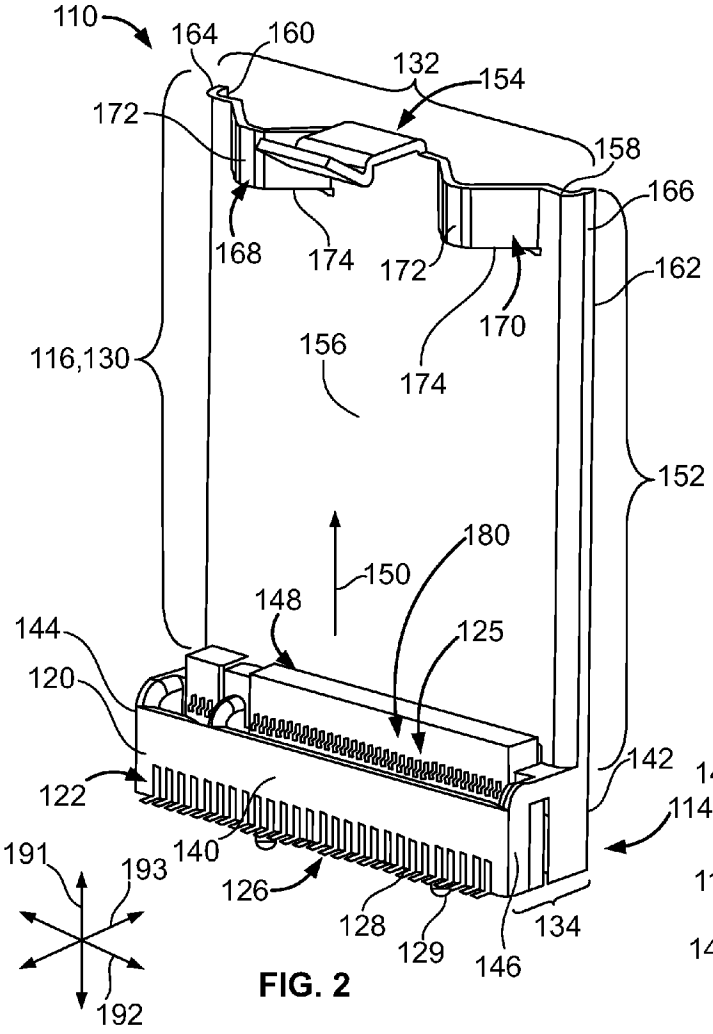
FIG. 2 is an isolated front perspective view of the connector assembly of FIG. 1.

FIG. 2 is an isolated front perspective view of the connector assembly 110, and FIG. 3 is an isolated back perspective view of the connector assembly 110. As described above, the connector assembly 110 includes the board connector 114 and the coupling mechanism 116. The connector assembly 110 has a height 130 that extends along the elevation axis 191, a width 132 that extends along the first lateral axis 192, and a depth or thickness 134 that extends along the second lateral axis 193. The height 130 is greater than the width 132 and the depth 134 and, as such, may represent the largest dimension of the connector assembly 110 according to a specific embodiment. For example, the width 132 and the depth 134 are smaller dimensions, with the width 132 being greater than the depth 134.

The board connector 114 includes a connector housing 120 and a plurality of electrical contacts 122 (FIG. 2) and electrical contacts 124 (FIG. 3) that are held by the connector housing 120. The electrical contacts 122, 124 form a contact array 125 (FIG. 2) that is configured to engage a corresponding array of the module card 112 (FIG. 1). When the board connector 114 is mounted to the circuit board 102, the contact array 125 extends parallel to the circuit board 102.

The connector housing 120 includes first and second housing sides 140, 142 that extend substantially parallel to each other along the first lateral axis 192. The second housing side 142 is demarcated by a dashed line in FIG. 3 and is attached to the coupling mechanism 116 along the dashed line. The first and second housing sides 140, 142 may define the depth 134 therebetween along the second lateral axis 193. The connector housing 120 also includes sidewalls 144, 146, which may define the width 132 therebetween along the first lateral axis 192.

The connector housing 120 also includes a mating side 148 that faces in a vertical (or load) direction 150 parallel to the elevation axis 191. As used herein, the term "vertical" does not require a particular orientation with respect to gravity. Instead, the term vertical describes a direction that is perpendicular to a plane of the circuit board 102. The mating side 148 is configured to engage the module card 112 (FIG. 1) during a loading operation. More specifically, the mating side 148 includes an opening to a reception slot 180 (FIG. 2). The reception slot 180 opens in the vertical direction 150 and is configured to receive the module card 112 as described herein.

The connector housing 120 also has a mounting side 126 that is opposite the mating side 148 and is configured to be mounted to or directly interface with the circuit board 102 (FIG. 1). In alternative embodiments, the mounting side 126 may be mounted to other components. The mounting side 126 may extend parallel to the first and second lateral axes 192, 193. A profile of the mounting side 126 is defined by a mounting edge 128 that is configured to extend along the circuit board 102 (FIG. 1).

The profile may define an area along the circuit board 102 that is occupied by the mounting side 126. The profile may be configured to fit within a limited area along the circuit board 102 (FIG. 1). For example, an area of the profile may be less than 200 $mm^2$ or, more particularly, less than 175 $mm^2$. In some embodiments, the height 130 may be at least three times (3×) the depth 134. In certain embodiments, the height 130 may be at least four times (4×), at least five times (5×), or at least six times (6×) the depth 134. In some embodiments, the height 130 may be at least 1.5 times (1.5×) the width 132.

In some embodiments, the connector housing 120 includes projections 129 along the mounting side 126 that facilitate securing the connector assembly 110 to the circuit board 102. The projections 129 may be, for example, posts or lugs that form an interference fit with openings or holes of the circuit board 102. In the illustrated embodiment, the projections 129 are within the profile of the mounting side 126. In other embodiments, the projections 129 may be secured to at least one of the sidewalls 144, 146 and/or at least one of the housing sides 140, 142 and project into the circuit board 102. However, it should be understood that other mechanisms for securing the board connector 114 to the circuit board 102 may be used. For example, hardware (e.g., screws) may be used to secure the board connector 114 and/or the connector assembly 110 to the circuit board 102.

The coupling mechanism 116 includes a support frame 152 that extends along the elevation axis 191 and at least one latch body 154 that projects transverse to the elevation axis 191 (i.e., parallel to at least one of the first and second lateral axes 192, 193). The latch body 154 is located opposite the contact array 125. In the illustrated embodiment, the support frame 152, the latch body 154, and the connector housing 120 are part of a unitary piece or integral structure. For example, a single structure may be cast, molded, or 3D-printed to include the support frame 152, the latch body 154, and the connector housing 120. In alternative embodiments, one or more of the support frame 152, the latch body 154, and the connector housing 120 are separate or discrete elements. For example, in an alternative embodiment, the support frame 152 and the latch body 154 may be portions of a unitary structure and the connector housing 120 may be discrete with respect to the unitary structure that includes the support frame 152 and the latch body 154. The discrete elements may be coupled to each other to form the connector assembly 110.

In the illustrated embodiment, the support frame 152 includes a vertical wall or panel 156 that extends along the elevation axis 191. The vertical wall 156 may be substantially planar without openings or recesses. In other embodiments, however, the vertical wall 156 may have one or more openings. For example, an opening may be formed through the vertical wall 156 that is sized and shaped to permit a finger to extend therethrough. Such an opening may facilitate removing the module card 112 from the loaded position. In other embodiments, openings may be provided to permit airflow through the vertical wall 156.

The support frame 152 includes wall edges 160, 162 that extend substantially parallel to the elevation axis 191 and a coupling or transverse edge 158 that may extend substantially parallel to the first lateral axis 192 and/or the second lateral axis 193. As shown, the support frame 152 may form side flanges 164, 166 along the height 130 of the connector assembly 110. The side flanges 164, 166 include the wall edges 160, 162, respectively. The side flanges 164, 166 may increase the structural integrity of the support frame 152. For example, the side flanges 164, 166 may project away from the vertical wall 156 in a direction transverse to the elevation axis 191. The side flanges 164, 166 may impede or resist tipping of the connector assembly 110.

The vertical wall 156 extends along the height 130 of the connector assembly 110 from the board connector 114 to the coupling edge 158. The latch body 154 is located proximate to the coupling edge 158. As used herein, the term "proximate" includes being near the object or, if possible, being attached to the object. For example, the latch body 154 is attached to and extends from the coupling edge 158. In other embodiments, the latch body 154 may be a small distance from the coupling edge 158, such as about 1-5 mm. In some embodiments, the latch body 154 is centrally located. For example, the latch body 154 may oppose a middle portion, such as the central one-third, of the reception slot 180. As shown in FIG. 2, the latch body 154 may oppose a center of the reception slot 180 in particular embodiments.

Optionally, the support frame 152 may include motion limiters 168, 170 that are located proximate to the coupling edge 158. In this case, the motion limiters 168, 170 are shaped from portions of the coupling edge 158. In other embodiments, however, the motion limiters 168, 170 may be separate from, but located near the coupling edge 158. For example, the motion limiters 168, 170 may be located about 1-10 mm from the coupling edge 158. Also shown, the motion limiters 168, 170 are spaced apart from each other with the latch body 154 being positioned between the motion limiters 168, 170 along the first lateral axis 192.

The motion limiters 168, 170 project away from the vertical wall 156 in a direction that is transverse or perpendicular to the elevation axis 191. The motion limiters 168, 170 are configured to engage the module card 112. As shown in FIG. 2, each of the motion limiters 168, 170 includes stop surfaces 172, 174. Each of the stop surfaces 172, 174 is configured to block or prevent the module card 112 from moving in a designated direction. In the illustrated embodiment, the motion limiters 168, 170 are triangular projections, but the motion limiters 168, 170 may have other shapes and configurations in other embodiments.

Figure 4:
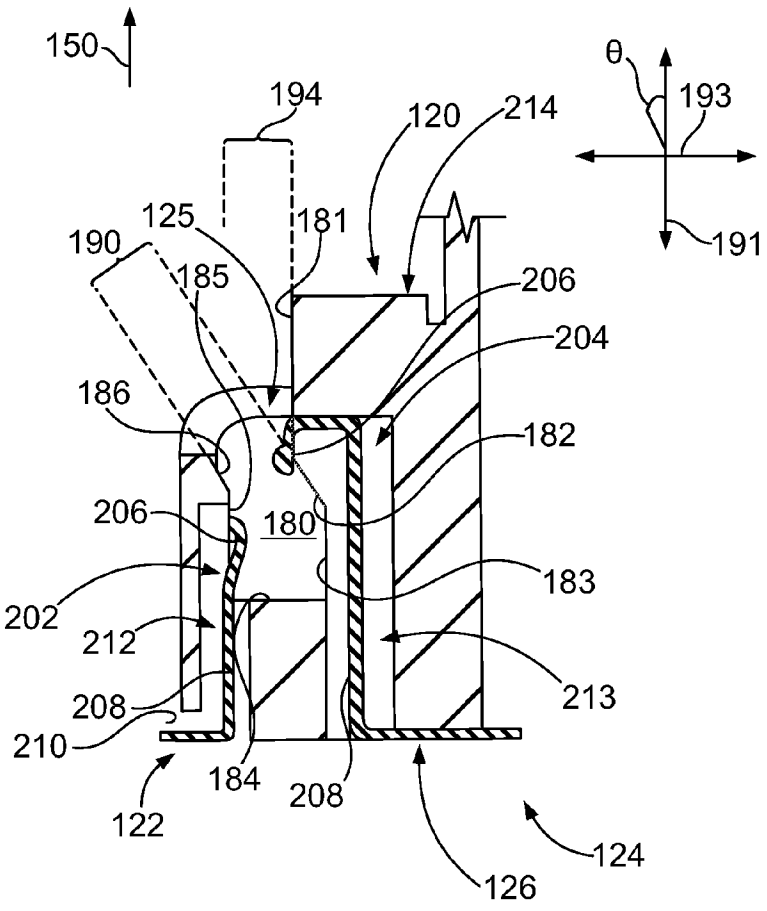
FIG. 4 is an enlarged cross-section of a portion of the connector assembly of FIG. 1.

FIG. 4 is a cross-section of a portion of the connector assembly 110. As shown, the reception slot 180 opens in the vertical direction 150 and is defined by inner housing surfaces 181-186 of the connector housing 120. The latch body 154 (FIG. 2) is positioned to face and/or be located opposite the reception slot 180. In an exemplary embodiment, the inner housing surfaces 181-186 are configured to receive a mating section 238 (shown in FIG. 5) of the module card 112 at an angle θ with respect to the elevation axis 191 and permit the mating section 238 of the module card 112 to rotate such that the module card 112 has a vertical orientation parallel to the elevation axis 191. For example, the inner housing surfaces 181-186 include angled surfaces 182, 186. According to a specific embodiment, the angled surfaces 182, 186 are generally parallel and form the angle θ with respect to the elevation axis 191. The angled surfaces 182, 186 define an insertion gap 190 therebetween. The insertion gap 190 is sized and shaped relative to the mating section 238 of the module card 112 so that the mating section 238 may be inserted into the reception slot 180.

The inner housing surfaces 181-186 also include a blocking surface 183. The blocking surface 183 is configured to engage a leading edge 246 of the mating section 238 and prevent the module card 112 from being inserted further into the reception slot 180 at the angle θ. The inner housing surfaces 181-186 may also include alignment surfaces 181, 184, 185. The alignment surfaces 181, 184, 185 are shaped to hold the mating section 238 at the loaded orientation. As the module card 112 is rotated into the loaded orientation, the alignment surfaces 181, 184, 185 may also provide a tactile indication that the module card 112 has reached the fully loaded orientation by impeding further rotation. As shown, the alignment surfaces 181, 185 are generally parallel and positioned substantially opposite each other along the second lateral axis 193 to define a loaded gap 194 measured along the second lateral axis 193. The loaded gap 194 is sized and shaped relative to the mating section 238 so that the module card 112 may be held in the fully loaded orientation. The loaded gap 194 may be equal to or less than the insertion gap 190.

In the illustrated embodiment, the contact array 125 formed by the electrical contacts 122, 124 includes first and second rows 202, 204. In other embodiments, however, the contact array 125 may include only one row of electrical contacts. The first and second rows 202, 204 are disposed to face each other and separated by a distance along the second lateral axis 193 such that the module card 112 is accommodated therebetween. Each of the electrical contacts 122, 124 includes a mating interface 206, an intermediate segment 208, and a terminating leg 210. Although FIG. 4 illustrates particular shapes for the electrical contacts 122, 124, it should be understood that the electrical contacts 122, 124 may include different shapes.

The mating interface 206 may be the portion of the corresponding electrical contact that is exposed within the reception slot 180. In the illustrated embodiment, the mating interface 206 includes an inflection point that may engage and slide along the mating section 238 of the module card 112. As shown, the mating interfaces 206 of the electrical contacts 122 and the mating interfaces 206 of the electrical contacts 124 are located at different heights relative to the mounting side 126. More specifically, the mating interfaces 206 of the electrical contacts 124 are located higher than the mating interfaces 206 of the electrical contacts 122.

The intermediate segment 208 extends between the mating interface 206 and the terminating leg 210. The intermediate segment 208 may be the portion of the corresponding electrical contact that is disposed within the connector housing 120. For example, the connector housing 120 includes contact cavities 212, 213. The intermediate segment 208 of the electrical contact 122 is disposed within the contact cavity 212, and the intermediate segment 208 of the electrical contact 124 is disposed within the contact cavity 213. The intermediate segment 208 may permit the mating interface 206 to flex between different positions.

The terminating leg 210 may be the portion of the corresponding electrical contact that is configured to mechanically and electrically couple to a conductive pathway (not shown) of the circuit board 102. In some embodiments, the terminating leg 210 may clear the connector housing 120 and be exposed to an exterior of the connector housing 120. As an example, the circuit board 102 may include an array of contact pads (not shown) that are exposed along a surface of the circuit board 102. Each terminating leg 210 may be soldered or otherwise mechanically and electrically coupled to the corresponding contact pad. To this end, the terminating leg 210 may be shaped to extend along the surface for a predetermined distance. In other embodiments, the terminating legs 210 may be pin-shaped and configured for insertion into plated thru-holes (not shown) of the circuit board 102.

Also shown in FIG. 4, the connector housing 120 includes a module surface 214 that faces in the vertical direction 150 along the elevation axis 191. The module surface 214 is configured to interface with a portion of the module card 112 (FIG. 1) when the module card is in the loaded orientation. The module surface 214 may also function as a positive stop that engages the module card 112 and blocks the module card 112 from moving further along the elevation axis 191.

Figure 5:
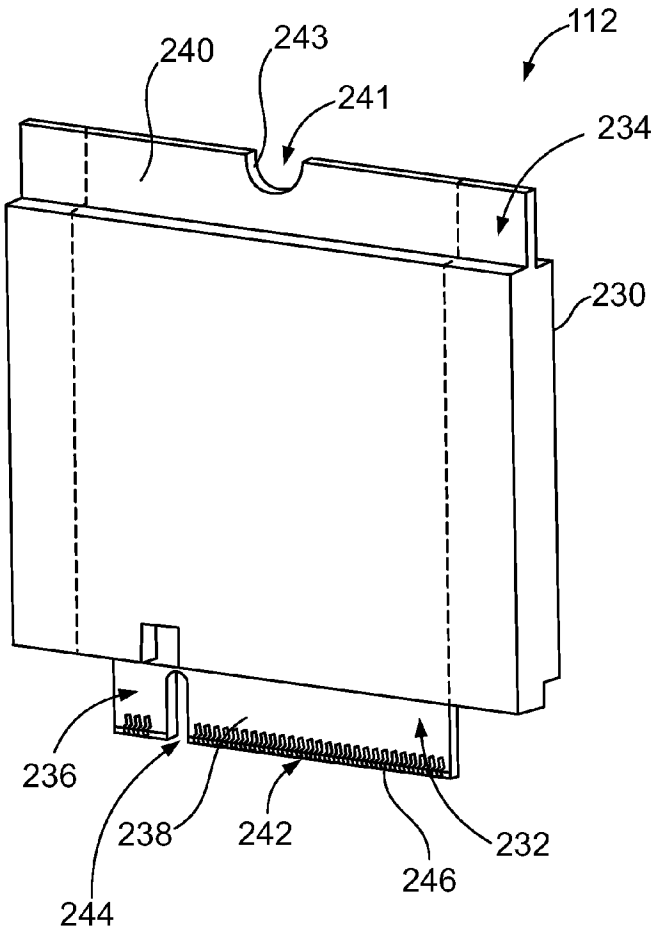
FIG. 5 is an isolated perspective view of a module card that may be loaded into the connector assembly of FIG. 1.

FIG. 5 is a perspective view of the module card 112. The module card 112 includes a module housing 230 having opposite front and back ends 232, 234 and a circuit board 236 coupled to the module housing 230. The mating section 238 is a portion of the circuit board 236. The circuit board 236 may include an operative handle or section 240 that projects from the back end 234 of the module housing 230. The operative handle 240 is configured to be gripped by an operator loading the module card 112. In alternative embodiments, the operative handle 240 may be a portion of the module housing 230. As shown, the operative handle 240 includes a latch opening 241 that is defined by a handle edge 243. The latch opening 241 is configured to receive a portion of the latch body 154 (FIG. 2). However, in alternative embodiments, the operative handle 240 does not include a latch opening.

The module housing 230 is configured to enclose and protect internal circuitry (not shown) of the module card 112. For example, the module card 112 may function as an SSD. In some embodiments, the module card 112 may include one or more processing units (e.g., microprocessors, application specific integrated circuits (ASICs), and the like). The processing units may be mounted to the circuit board 236 and electrical coupled to corresponding contacts 242 along the mating section 238. In particular embodiments, the module card 112 is a next generation form factor (NGFF) or M.2 module card. The module card 112 may be able to perform at enhanced data rates, such as those found with Peripheral Component Interconnect (PCI) Express 3.0, Universal Serial Bus (USB) 3.0, and SATA 3.0 specifications.

The mating section 238 includes a leading edge 246 and first and second rows of the corresponding contacts 242 (only the first row is shown in FIG. 5). The corresponding contacts 242 are positioned proximate to the leading edge 246. The corresponding contacts 242 may be arranged in various manners based on the intended application. By way of example, the first row of corresponding contacts 242 may include 33 contacts at a 0.5 mm pitch. The mating section 238 may also include a keying slot 244 that is configured to receive a portion of the connector housing 120 (FIG. 1).

Figure 6:
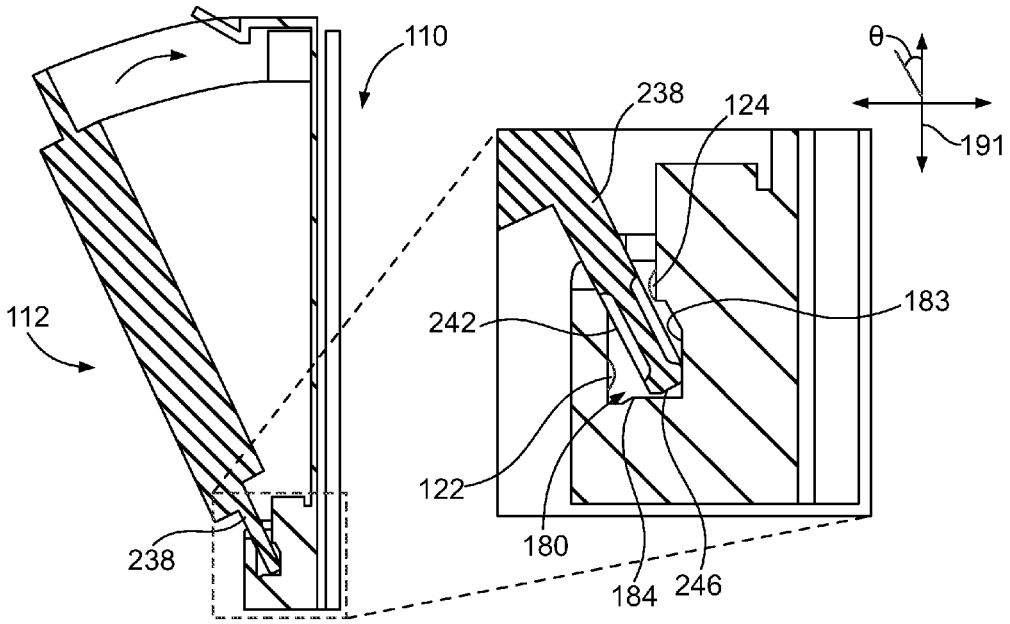
FIG. 6 illustrates a cross-section of the connector assembly during a loading operation with a module card.

FIG. 6 illustrates a cross-section of the connector assembly 110 in which the module card 112 is in a pre-loaded orientation. As shown, the mating section 238 is positioned within the reception slot 180. To insert the mating section 238 into the reception slot 180, the module card 112 is positioned such that the mating section 238 is oriented at the angle θ with respect to the elevation axis 191. The angle θ may be, for example, between 10° and 45°. In some embodiments, the angle θ may be between 10° and 30°. In particular embodiments, the angle θ may be between 10° and 20°.

As shown in the enlarged view of FIG. 6, the leading edge 246 may be inserted through the insertion gap 190 and advanced until the leading edge 246 engages the blocking surface 183 and/or the alignment surface 184. As the leading edge 246 is advanced into the reception slot 180, the mating section 238 may engage the electrical contacts 124 and, optionally, the electrical contacts 124. More specifically, the mating section 238 may engage the mating interfaces 206 (FIG. 4) and deflect the corresponding electrical contacts 122, 124 into the respective contact cavities 212, 213 (FIG. 4). The mating section 238 may slide along the mating interfaces 206. Once in the pre-loaded orientation shown in FIG. 6, the module card 112 may be rotated until the module card 112 and/or the mating section 238 extends parallel to the elevation axis 191. In the fully loaded orientation (shown in FIG. 7), the electrical contacts 122, 124 are engaged to the corresponding contacts 242 of the module card 112.

Figure 7:
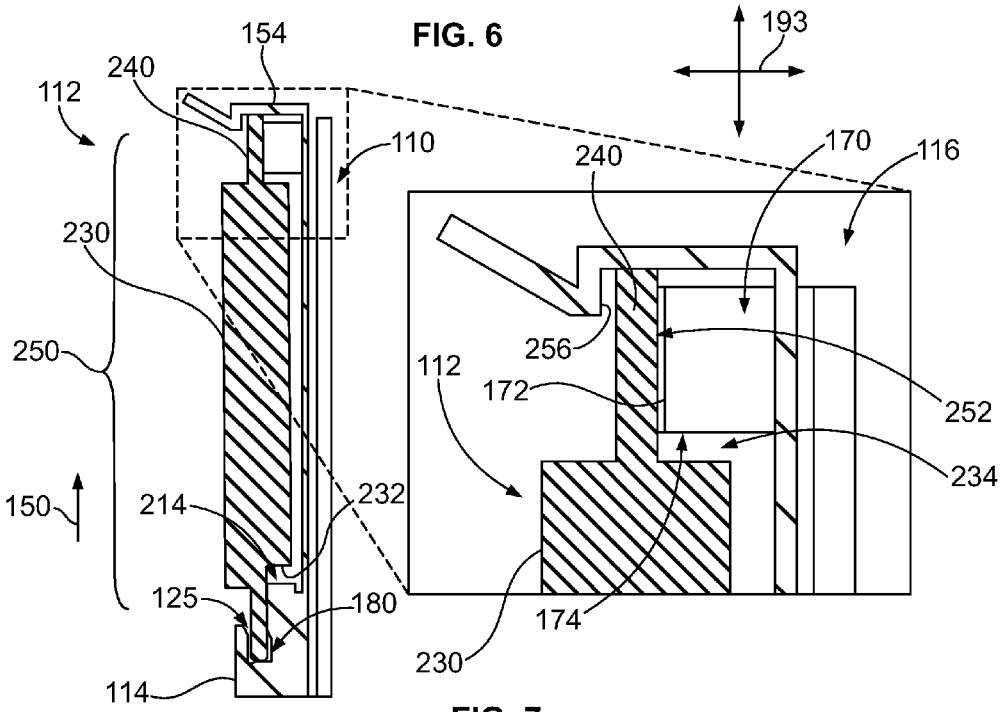
FIG. 7 illustrates a cross-section of the connector assembly after the module card has been loaded into the connector assembly.

FIG. 7 illustrates a cross-section of the connector assembly 110 when the module card 112 is in the fully loaded orientation. The latch body 154 opposes the reception slot 180 and/or the contact array 125 such that a module-receiving space 250 is defined therebetween. As shown, the module-receiving space 250 is configured to receive the module card 112. More specifically, the module-receiving space 250 is configured to receive the module housing 230 and the operative handle 240. The front end 232 of the module housing 230 interfaces with the module surface 214.

As the module card 112 is rotated from the pre-loaded orientation (FIG. 6) to the fully loaded orientation (FIG. 7), the latch body 154 may engage the operative handle 240. In some embodiments, the latch body 154 may be deflected away from the board connector 114 to enlarge the module-receiving space 250 so that the module card 112 may be received therein. Once the operative handle 240 clears the latch body 154, the latch body 154 may flex toward the undeflected position. In some embodiments, an individual (e.g., technician) may move the latch body 154 away from the board connector 114 to enlarge the module-receiving space 250 using a thumb or finger. Once the module card 112 is in the fully loaded orientation, the technician may permit the latch body 154 to move toward the undeflected position.

As shown in the enlarged view of FIG. 7, when the module card 112 is in the fully loaded orientation, the coupling mechanism 116 facilitates securing the module card 112 so that the module card 112 is not inadvertently removed from the fully loaded orientation. For instance, the stop surface 172 of the motion limiter 170 engages a first side 252 of the operative handle 240, and the stop surface 172 interfaces with the back end 234 of the module housing 230. The latch body 154 includes a grip surface 256 that interfaces with the operative handle 240. The grip surface 256 and the stop surface 172 generally face each other along the second lateral axis 193. As such, the operative handle 240 is secured between the grip and stop surfaces 256, 172 and is blocked from moving in either direction along the second lateral axis 193. Moreover, the stop surface 174 prevents the module card 112 from moving in the vertical direction 150 away from the board connector 114. Accordingly, the coupling mechanism 116 may hold the module card 112 in the fully loaded orientation throughout operation and prevent the module card 112 from being inadvertently dislodged from the board connector 114.

Figure 8:
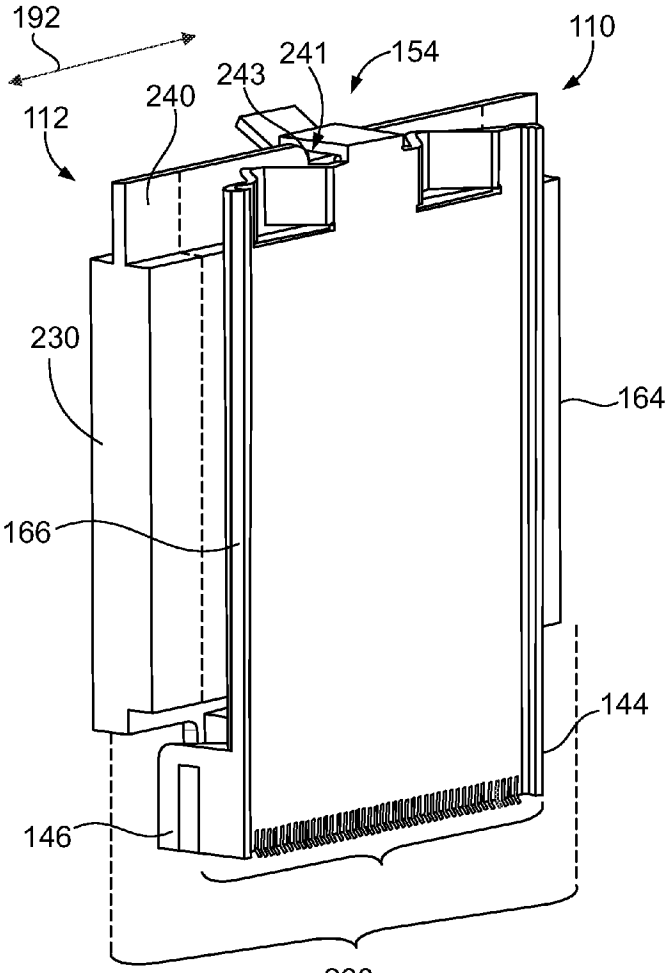
FIG. 8 is a back perspective view of the connector assembly loaded with the module card.

FIG. 8 is a back perspective view of the connector assembly 110 loaded with the module card 112. As shown, the latch body 154 is partially disposed within the latch opening 241 of the operative handle 240. The latch body 154 may engage the handle edge 243 on each side of the latch body 154. In such embodiments, the latch body 154 may engage the operative handle 240 and impede or resist movement of the module card 112 in either direction along the first lateral axis 192.

In some embodiments, the connector assembly 110 is open or clear above the sidewalls 144, 146. In such embodiments, the connector assembly 110 may receive module cards with module housings of different sizes. For example, the module housing 230 of the module card 112 has a width 260. The width 260 may be, for example, thirty (30) mm. The module housing 230 clears or extends beyond each of the side flanges 164, 166. However, the connector assembly 110 may also be configured to receive a module housing (not shown) having a width 262. The width 262 is partially indicated by a dashed line extending vertically along the module card 112. The width 262 may be substantially equal to the width 132 (FIG. 2) of the connector assembly 110 such that the alternative module housing does not clear either of the side flanges 164, 166. Accordingly, the open-sided configuration of the connector assembly 110 may permit the connector assembly 110 to receive module cards of a variety of sizes.

Figure 9:
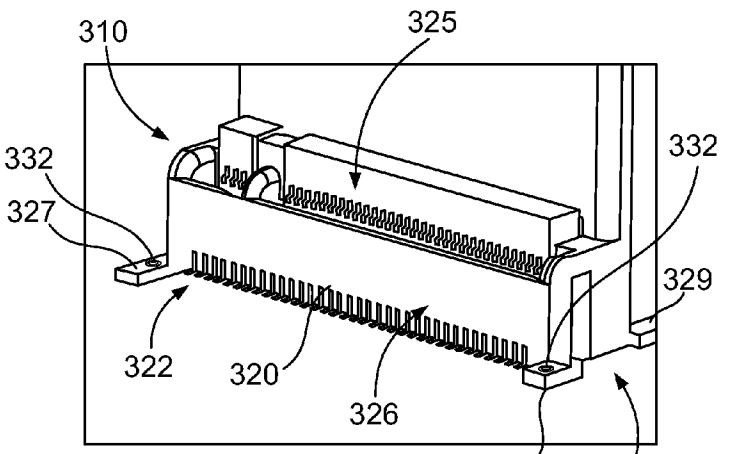
FIG. 9 is a front perspective view of a portion of a connector assembly formed in accordance with an embodiment.
Figure 10:
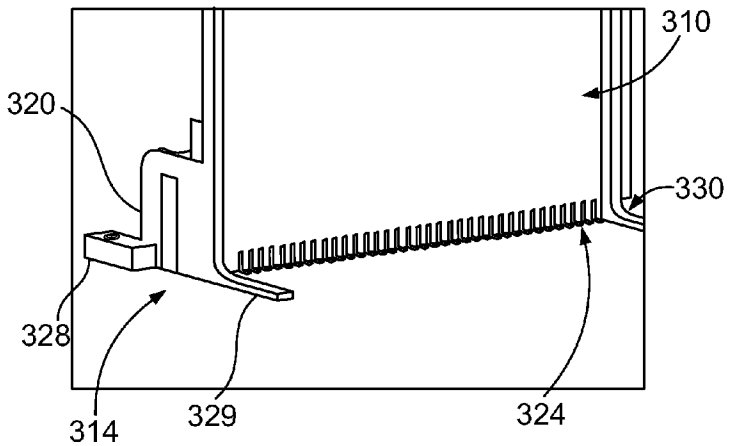
FIG. 10 is a back perspective view of a portion of the connector assembly of FIG. 9.

FIGS. 9 and 10 are front and back perspective views, respectively, of a connector assembly 310 in accordance with an embodiment having a board connector 314. The connector assembly 310 and the board connector 314 may be similar to the connector assembly 110 (FIG. 1) and the board connector 114 (FIG. 1), respectively. The board connector 314 is configured to be mounted to a circuit board (not shown). The board connector 314 includes a connector housing 320 having a contact array 325 of electrical contacts 322 (FIG. 9) and electrical contacts 324 (FIG. 10).

The connector housing 320 may be configured to stabilize and/or provide structural integrity to the connector assembly 310 to prevent the connector assembly 310 from being inadvertently moved from the circuit board. More specifically, the connector housing 320 includes a main body 326 and housing legs 327-330 that extend away from the main body 324. Optionally, the housing legs 327, 328 may include fastener holes for receiving hardware 332 (e.g., screws) for securing the connector assembly 310 to the circuit board. In alternative embodiments, the connector housing 320 may also include projections (not shown) that are similar to the projections 129 (FIG. 2).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A connector assembly comprising:

a board connector configured to be mounted to a circuit board and including a connector housing having a reception slot, the reception slot opening in a vertical direction that is parallel to an elevation axis, the elevation axis being perpendicular to the circuit board when the board connector is mounted thereto, the board connector also including electrical contacts that are positioned along the reception slot, the electrical contacts configured to engage corresponding contacts of a module card; and a coupling mechanism including a support frame that is directly attached to the board connector and extends away from the board connector along the elevation axis, the coupling mechanism also including a latch body that is attached to the support frame and faces the reception slot to define a module-receiving space therebetween that is configured to receive the module card;

wherein the support frame includes a vertical wall that extends parallel to the elevation axis, the connector housing of the board connector and the vertical wall of the support frame being part of a single unitary structure, the vertical wall being directly attached to and extending away from the connector housing.

2. The connector assembly of claim 1, wherein the electrical contacts form an array that extends parallel to the circuit board when the board connector is mounted thereto, the array of electrical contacts including first and second rows of the electrical contacts, the first and second rows facing in opposite directions.

3. The connector assembly of claim 2, wherein each of the electrical contacts has a mating interface configured to engage one of the corresponding contacts of the module card, the mating interfaces having different heights along the elevation axis.

4. The connector assembly of claim 1, wherein the reception slot is sized and shaped to receive a mating section of the module card when the mating section is inserted into the reception slot at an angle with respect to the elevation axis, the angle being from 10° to 45°, the reception slot being sized and shaped to permit the mating section to rotate within the reception slot such that the mating section is parallel to the elevation axis after rotation.

5. The connector assembly of claim 1, wherein the support frame includes a motion limiter having a stop surface and the latch body includes a grip surface, the stop surface and the grip surface facing in opposite directions along a lateral axis and being positioned to engage opposite sides of the module card at separate portions of the module card.

6. The connector assembly of claim 1, wherein the latch body has a height measured along the elevation axis, the board connector has a depth measured along a lateral axis that is perpendicular to the elevation axis, the height of the latch body being at least four times (4×) the depth of the board connector.

7. The connector assembly of claim 1, wherein each of the electrical contacts includes a mating interface, a terminating leg, and an intermediate segment that extends between the mating interface and the terminating leg, the intermediate segment permitting the mating interface to flex between different positions, the terminating leg oriented to extend alongside a top surface of the circuit board and configured to be terminated to the top surface of the circuit board.

8. The connector assembly of claim 1, wherein the support frame includes a vertical wall that extends parallel to the elevation axis and a first lateral axis, the support frame also including a motion limiter that is configured to engage the module card, the motion limiter and the latch body projecting from the vertical wall substantially transverse to the elevation axis, the motion limiter and the latch body being separated from each other along a second lateral axis that is perpendicular to the first lateral axis and the vertical axis.

9. The connector assembly of claim 1, wherein the vertical wall extends along the elevation axis and a first lateral axis, wherein the connector assembly has a maximum width that is measured along the first lateral axis and is defined by the board connector or the support frame, the module-receiving space being open-sided such that a module card having a width that is greater than the maximum width may be received by the connector assembly.

10. The connector assembly of claim 1, wherein the support frame has opposite side flanges, the module-receiving space being open-sided such that the module card may clear each of the side flanges of the support frame when the module card is received by the connector assembly.

11. The connector assembly of claim 10, wherein the side flanges project away from the vertical wall in a direction that is transverse to the elevation axis and the first lateral axis, the side flanges being shaped to impede or resist tipping of the connector assembly.

12. The connector assembly of claim 1, wherein the connector housing has a mounting side that is configured to be mounted to or directly interface with the circuit board, the board connector along the mounting side being the only portion of the connector assembly, except for the electrical contacts, that engages the circuit board.

13. The connector assembly of claim 1, wherein the connector housing has a mounting side that is configured to be mounted to or directly interface with the circuit board, the mounting side having a mounting edge that defines an outer profile of the mounting side, the outer profile defining an area along the circuit board that is occupied by the connector assembly.

14. A connector assembly comprising:

a board connector configured to be mounted to a circuit board and including a connector housing having a reception slot, the reception slot opening in a vertical direction that is parallel to an elevation axis, the elevation axis being perpendicular to the circuit board when the board connector is mounted thereto, the board connector also including electrical contacts that are positioned along the reception slot, the electrical contacts configured to engage corresponding contacts of a module card; and a coupling mechanism including a support frame that is directly attached to the board connector and extends away from the board connector along the elevation axis, the coupling mechanism also including a latch body that is attached to the support frame and faces the reception slot to define a module-receiving space therebetween that is configured to receive the module card;

wherein the support frame includes a vertical wall that extends parallel to the elevation axis and a first lateral axis, the support frame also including a motion limiter that is configured to engage the module card, the motion limiter and the latch body projecting from the vertical wall substantially transverse to the elevation axis, the motion limiter and the latch body being separated from each other along a second lateral axis that is perpendicular to the first lateral axis and the vertical axis.

15. The connector assembly of claim 14, wherein the connector housing of the board connector and the vertical wall of the support frame are part of a single unitary structure, the vertical wall being directly attached to and extending away from the connector housing.

16. A communication system comprising:

a circuit board oriented perpendicular to an elevation axis;

a board connector mounted to the circuit board, the board connector including a connector housing having a reception slot that opens in a vertical direction parallel to the elevation axis, the reception slot extending lengthwise parallel to the circuit board, the board connector also including electrical contacts that are positioned along the reception slot, the electrical contacts configured to engage corresponding contacts of a module card; and a coupling mechanism including a support frame that is directly attached to the board connector and has a fixed position with respect to the board connector, the support frame extending away from the board connector along the elevation axis, the coupling mechanism also including a latch body that is attached to the support frame and faces the reception slot to define a module-receiving space therebetween that is configured to receive the module card;

wherein the support frame includes a vertical wall that extends parallel to the elevation axis, the connector housing of the board connector and the vertical wall of the support frame being part of a single unitary structure, the vertical wall being directly attached to and extending away from the connector housing.

17. The communication system of claim 16, wherein the electrical contacts form an array that extends parallel to the circuit board, the array of electrical contacts including first and second rows of the electrical contacts, the first and second rows facing in opposite directions.

18. The communication system of claim 17, wherein each of the electrical contacts has a mating interface configured to engage one of the corresponding contacts of the module card, the mating interfaces having different heights along the elevation axis.

19. The communication system of claim 16, wherein the reception slot is sized and shaped to receive a mating section of the module card when the mating section is inserted into the reception slot at an angle with respect to the elevation axis, the angle being from 10° to 45°, the reception slot being sized and shaped to permit the mating section to rotate within the reception slot such that the mating section is parallel to the elevation axis after rotation.

20. The communication system of claim 16, wherein the support frame includes a motion limiter having a stop surface and the latch body includes a grip surface, the stop surface and the grip surface facing in opposite directions along a lateral axis and being positioned to engage opposite sides of the module card at separate portions of the module card.

* * * * *